US006439982B1

(12) United States Patent
Klukos

(10) Patent No.: US 6,439,982 B1
(45) Date of Patent: Aug. 27, 2002

(54) BALL SPINNER AND POLISH APPARATUS

(76) Inventor: Edward O. Klukos, 10030 152nd Ave., West Olive, MI (US) 49460

( * ) Notice: Subject to any disclaimer, the term of this patent is extended or adjusted under 35 U.S.C. 154(b) by 0 days.

(21) Appl. No.: 09/455,132

(22) Filed: Dec. 6, 1999

(51) Int. Cl.[7] ..... B24B 11/02
(52) U.S. Cl. ..... 451/307; 451/50
(58) Field of Search ..... 451/307, 50, 406, 451/180, 317, 211; 15/21.2, 21.1

(56) References Cited

U.S. PATENT DOCUMENTS

| | | | | | |
|---|---|---|---|---|---|
| 2,420,988 | A | * | 5/1947 | Tholen | 15/21.2 |
| 2,438,773 | A | * | 3/1948 | Warlick | 451/317 |
| 2,588,714 | A | * | 3/1952 | Fleming | 15/21.2 |
| 3,111,789 | A | * | 11/1963 | Harmon | 451/211 |
| 3,151,419 | A | * | 10/1964 | Ray | 451/180 |
| 3,249,957 | A | * | 5/1966 | Secord | 15/21.2 |
| 3,289,354 | A | * | 12/1966 | Stevens et al. | 451/50 |
| 4,192,034 | A | * | 3/1980 | Knepper, Jr. | 15/21 A |

* cited by examiner

*Primary Examiner*—Robert A. Rose
(74) *Attorney, Agent, or Firm*—Price, Heneveld, Cooper, DeWitt & Litton

(57) ABSTRACT

An apparatus is provided for polishing balls that comprises a cradle that is supported for rotation about a first axis. The cradle is shaped to support a spherical object and includes a ball spinner positioned and adapted to spin the spherical object in the cradle about a second axis that is oriented at an angle to the first axis. The apparatus also comprises a first drive operably connected to the cradle for rotating the cradle about the first axis at a first speed of rotation, and a second drive connected to the ball spinner to spin the spherical object about the second axis at a second speed of rotation. Also provided is a method for polishing spherical objects, comprising the steps of: a) providing a cradle apparatus having at least two wheels for supporting and spinning a spherical object; b) providing a first drive and a second drive; c) providing a polishing apparatus having a tape holder and a tape support; d) rotating the wheels in the same direction about a first axis using the first drive; e) rotating the wheels in the same direction about a second axis using a second drive; and f) pressing the tape against the spherical object while the spherical object is spinning.

19 Claims, 9 Drawing Sheets

BALL SPINNER AND POLISH APPARATUS

BACKGROUND OF THE INVENTION

The present invention relates to ball polishers and related apparatuses.

Bowling is a sport in which it is important to have very even and uniformly polished surfaces on both the bowling lane and the bowling ball. Having even surfaces is especially important for the professional or "scratch" amateur bowler since even surfaces lead to consistency, which in turn leads to excellence in the sport of bowling. Therefore, it is very important in the sport of bowling to have a very evenly polished bowling ball.

In the past, it has been very difficult or very costly to achieve an evenly polished bowling ball. Currently, most bowling ball polishing is done by a manual operation where the user holds the ball against a polishing cloth on wheels and turns the ball to polish the entire surface of the bowling ball. The manual operation often leads to an uneven polish and furthermore takes several minutes to polish a ball. Other apparatuses have also been used, but most apparatuses lead to "hot spots" on the bowling ball where one area is polished more or less than the remaining areas on the bowling ball. Therefore, it is a desire of bowlers and the bowling industry to have an apparatus that will provide a very evenly polished bowling ball in a short amount of time and at a relatively inexpensive cost.

Other industries also have a need for evenly polished spherical objects. For example, large glass spheres used in large telescopes need to be evenly polished to provide optimum performance. Thus, there is a need for a ball polisher that will provide an even polish on a variety of different spherical objects.

SUMMARY OF THE INVENTION

One aspect of the present invention is an apparatus for multi-axial rotation of a spherical object comprising a cradle that is supported for rotation about a first axis. The cradle is shaped to support a bowling ball and includes a ball spinner positioned and adapted to spin the bowling ball in the cradle about a second axis that is oriented at an angle to the first axis. The apparatus also comprises a first drive operably connected to the cradle for rotating the cradle about the first axis at a first speed of rotation, and a second drive connected to the ball spinner to spin the spherical object about the second axis at a second speed of rotation.

Another aspect of the present invention is an apparatus for rotating a spherical object comprising a pair of wheels with edges arranged to engage and rotate a spherical object. The apparatus also includes a first drive connected to the pair of wheels for rotating them in opposite directions about a first axis. A second drive is connected to the wheels for rotating the pair of wheels simultaneously in the same direction about a second axis.

Still another aspect of the present invention is an apparatus comprising a ball-holding device adapted to spin a bowling ball about a constantly changing axis, a polisher including a holder for holding polishing tape against a bowling ball supported on the ball-holding device, and a fluid dispenser for placing fluid on the bowling ball while the bowling ball is being spun.

Yet another aspect of the present invention is an apparatus comprising a tape holder and tape support having an arcuate shape. The apparatus also comprises a dispenser mechanism adapted to periodically motivate the tape to position a new section adjacent to the tape support.

Still yet another aspect of the present invention is a method of polishing a spherical object comprising the steps of: a) providing a cradle apparatus having at least two wheels for supporting and spinning a spherical object; b) providing a first drive and a second drive; c) providing a polishing apparatus having a tape holder and a tape support; d) rotating the wheels in the same direction about a first axis using the first drive; e) rotating the wheels in the same direction about a second axis using a second drive; and f) pressing the tape against spherical object while the spherical object is spinning.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 3:
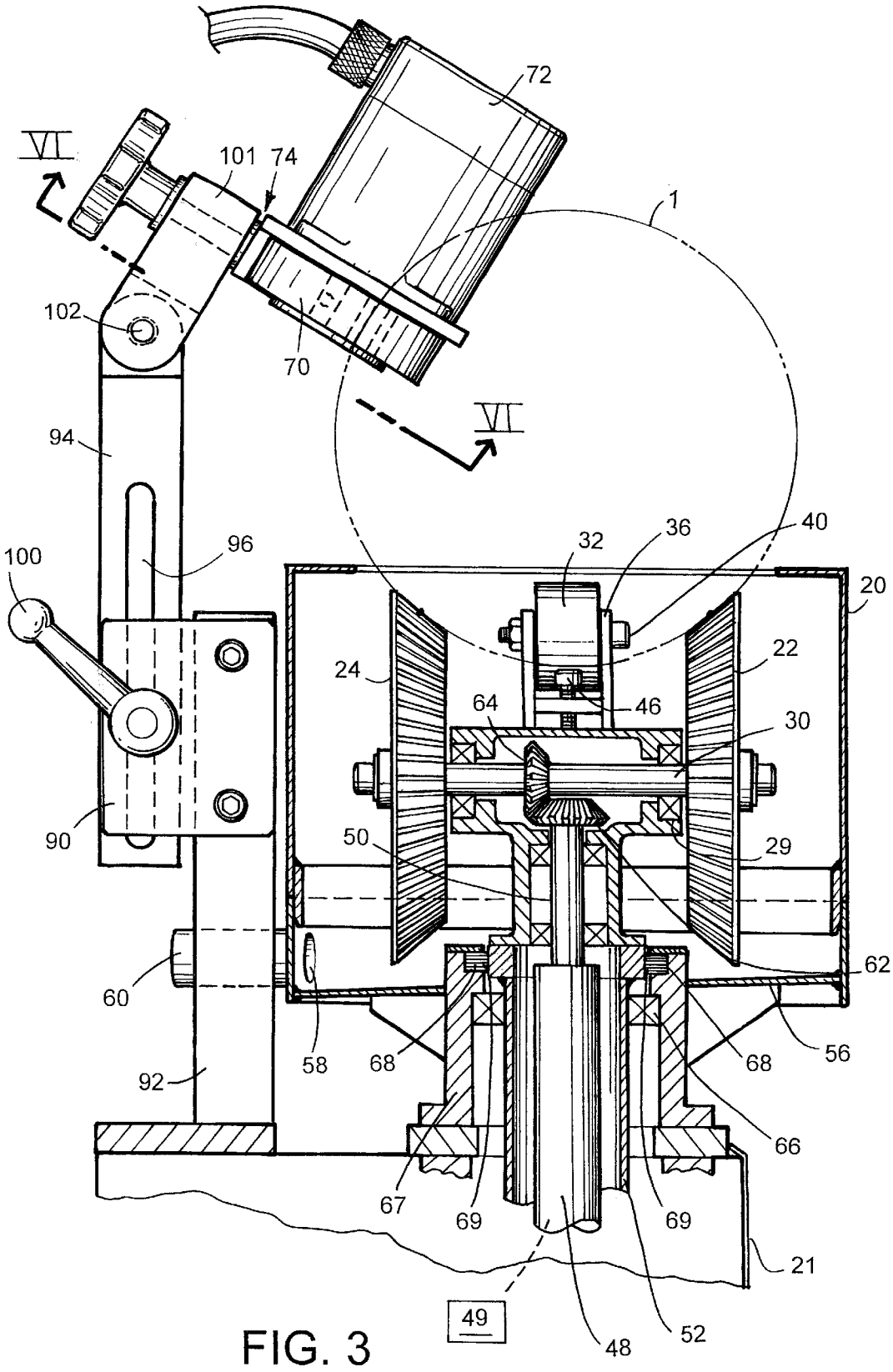
FIG. 3 is a partial cut-away view of the ball spinner and polisher apparatus of the present invention.

For purposes of description herein, the terms "upper," "lower," "right," "left," "rear," "front," "vertical," "horizontal," and derivatives thereof shall relate to the invention as oriented in FIG. 3, the front of the bowling ball spinner facing out from the printed page. However, it is to be understood that the invention may assume various alternative orientations, except where expressly specified to the contrary. It is also to be understood that the specific devices and processes illustrated in the attached drawings, and described in the following description are simply exemplary embodiments of the inventive concepts defined in the appended claims. Hence, specific dimensions or other physical characteristics relating to the embodiments disclosed herein are not to be considered at limiting unless the claims expressly state otherwise.

Figure 1:
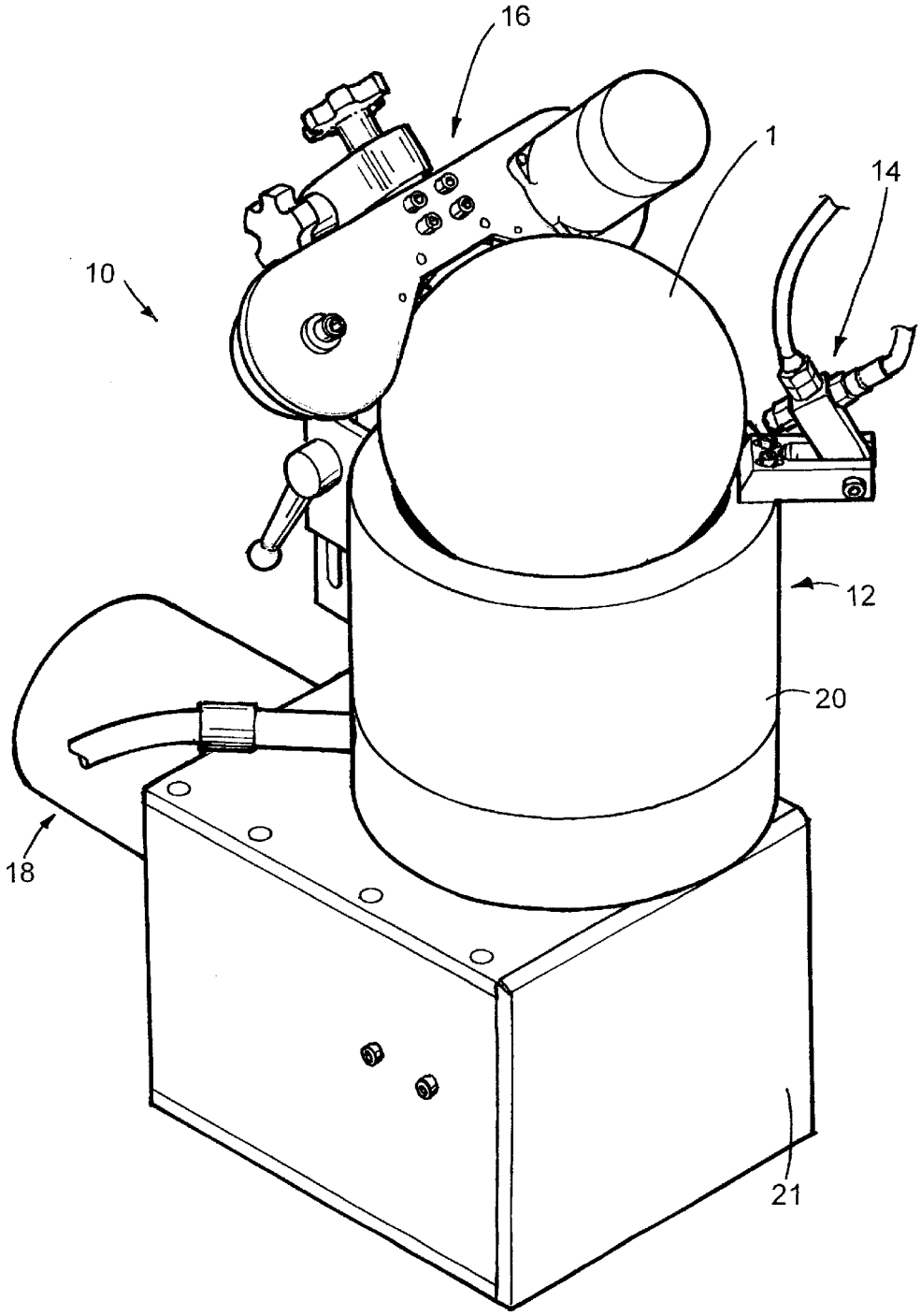
FIG. 1 is a perspective view of the ball spinner and polish apparatus of the present invention.

As shown in FIG. 1, the ball spinner and polisher apparatus 10 of the present invention generally includes a ball spinner 12, a fluid dispenser 14, a polisher 16, and a motorized drive 18.

Figure 2:
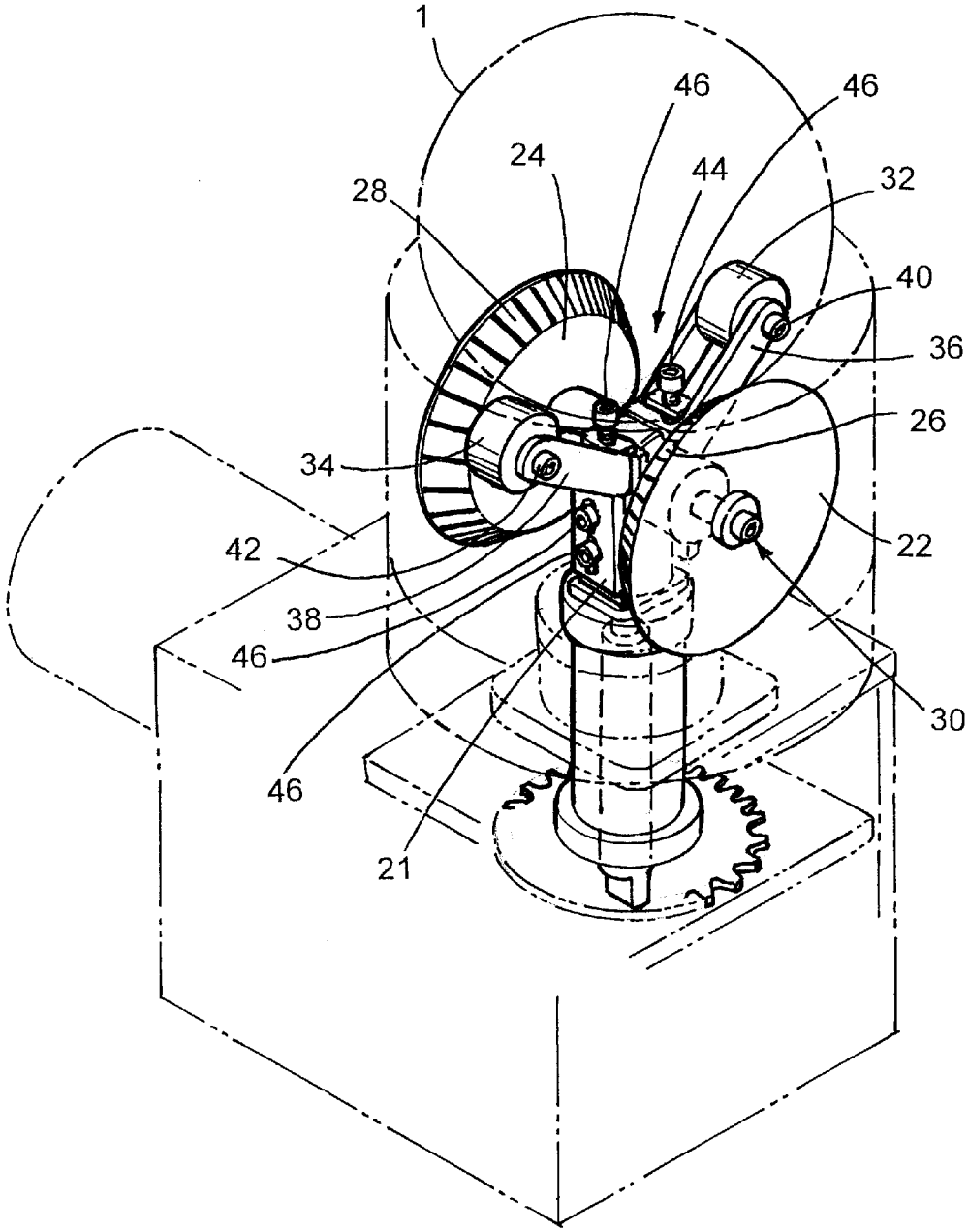
FIG. 2 is a prespective view of the ball spinner of the present invention.

Ball spinner 12 is enclosed by a housing 20 and base 21. Ball spinner 12 includes a pair of wheels 22, 24 (FIG. 2). Wheels 22, 24 have a thickness of approximately one inch and each has an inner diameter that is smaller than the respective outer diameter, creating a beveled edge 26 on wheel 22 and a beveled edge 28 on wheel 24. The beveled edges are preferably 45°, but may be varied slightly, which will in turn vary the polishing pattern on the ball. Wheels 22, 24 are both fixedly attached to an axle 30 that allows rotation of the wheels in the same direction. Axle 30 is rotatably attached to a frame 29 and much of axle 30 sits in a chamber 31 within frame 29 (FIG. 3). Wheels 22, 24 can be made of any resilient substance that will allow the bowling ball to rotate thereon, but a synthetic rubber is preferred due to its flexibility, strength, and surface friction characteristics which allow the ball to be moved thereon, while creating drive friction between the ball and wheels. Ball spinner 12 also includes two small wheels 32, 34 that are connected to frame 29 by brackets 36 and 38, respectively. Small wheels 32, 34 are rotatably attached to brackets 36 and 38 by bolts 40 and 42, respectively, which allow rotation of the small wheels. Small wheels 32, 34 are preferably made of a durable but somewhat flexible synthetic polymer, such as that used for in-line skate wheels, but may be made of any substance that will provide a moderate friction between the small wheels and a ball, such as a bowling ball. Wheels 22, 24 with edges 26, 28, and small wheels 32, 34 create a cradle 44 in which a bowling ball can be supported. Brackets 36, 38 are attached to frame 29 by set screws 46 which allow tightening of the brackets to the frame, while allowing fine vertical adjustment of the positioning of the small wheels 32, 34 so that optimum performance of ball spinner 12 is achieved.

Figure 5:
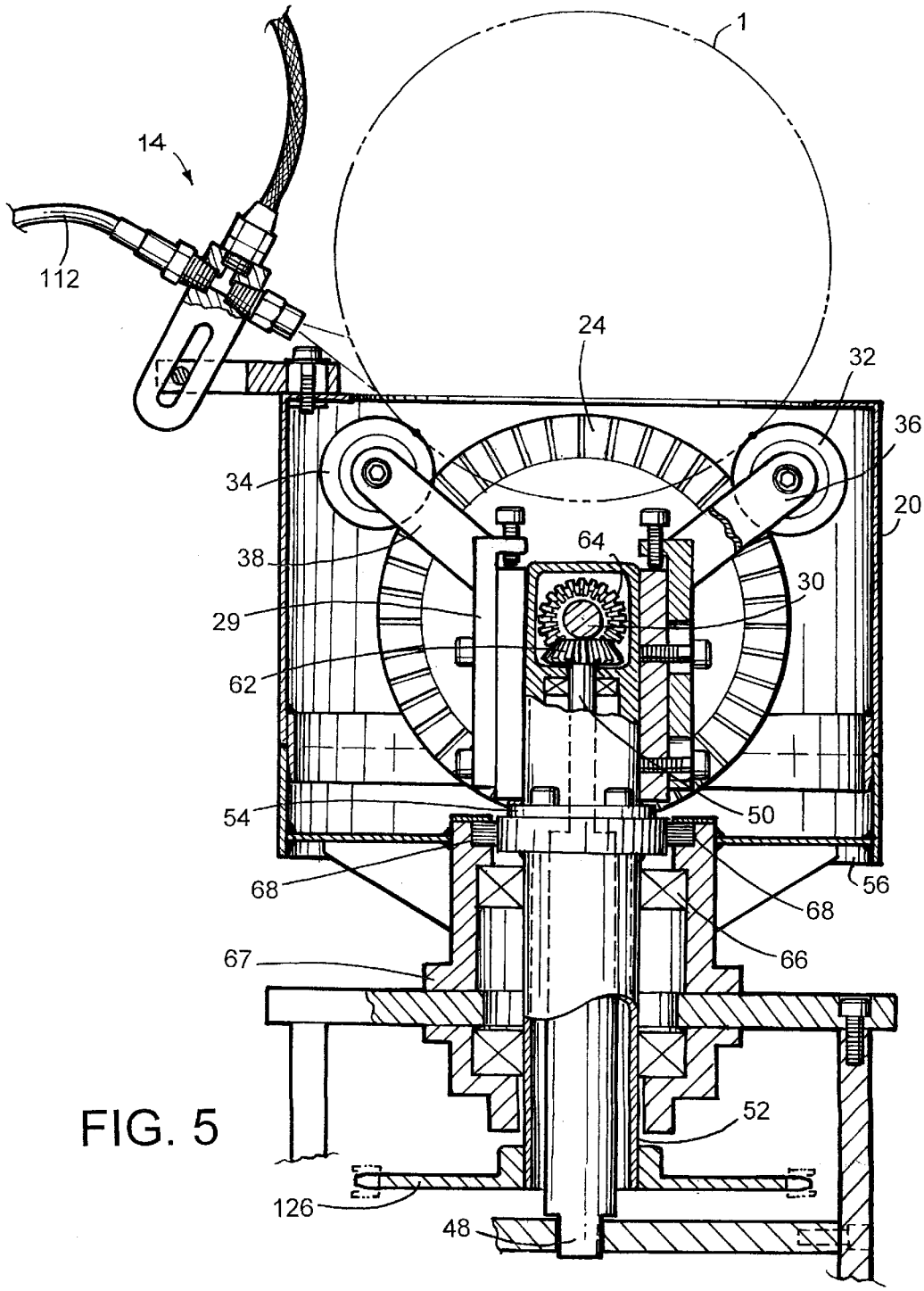
FIG. 5 is a cut-away view of the ball spinner and spraying apparatus of the present invention.

Ball spinner 12 further includes a vertical cylindrical shaft 48 that has a smaller diameter portion 50 (FIG. 3). Surrounding vertical cylindrical shaft 48 is a tubular casing 52 which is connected to base portion 54 of frame 29 (FIG. 5). Tubular casing 52 is rotatable, and thus when rotated it in turn rotates smaller diameter portion 50 and cradle 44, as discussed in further detail below. Vertical cylindrical shaft 48 may be stationary, or may be rotatable. If rotatable, vertical cylindrical shaft 48 is attached to a motor 49, which is preferably a servo type motor. Varying the rotation of vertical cylindrical shaft 48 in either a clockwise or counterclockwise direction, along with rotation of tubular casing 52, changes the polishing pattern on the ball. This variability of polishing patterns results in an apparatus that can be used on balls of a variety of different materials while achieving an optimum polishing effect.

Housing 20 is generally cylindrical and includes a bottom tray 56 that slants downwardly toward an opening 58. Connected to opening 58 of housing 20 is a drain tube 60 that permits flow of fluid therethrough. On the end of the small cylinder portion 50 of vertical cylinder 48 is a horizontally positioned gear 62. Gear 62 rests in chamber 31 inside frame 29. Attached to axle 30 is a second gear 64 that is positioned vertically and is in engagement with gear 62 in chamber 31.

Ball spinner 12 further includes a bearing 66, which surrounds cylindrical casing 52 and is within a bottom housing 67. Bearing 66 reduces the friction of casing 52 as it is spun. Also within bottom housing 67 is a collar 69. A seal 68 sits within collar 69. Seal 68 is preferably made of a felt-like, water-resistant cloth material, but may be made from any material that will prevent fluid, and in particular water, from entering into housing 67. The material is beveled and pressed into collar 69 in bottom housing 67 to create a liquid-tight seal. The purpose of seal 68 is to prevent water that drips from ball 1 from entering housing 67 and affecting the performance of bearing 66. The function and action of the water dispensed onto bowling ball 1 is described in more detail below.

Figure 4:
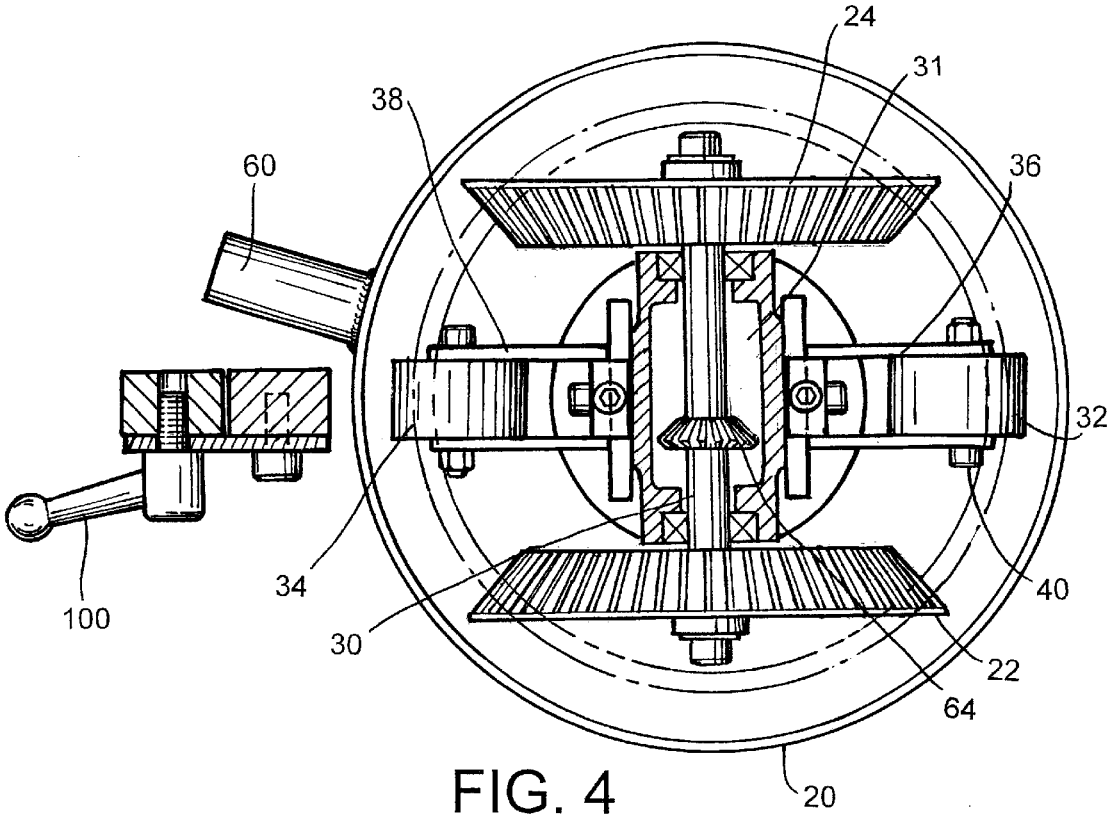
FIG. 4 is a top view of the ball spinner of the present invention.
Figure 6:
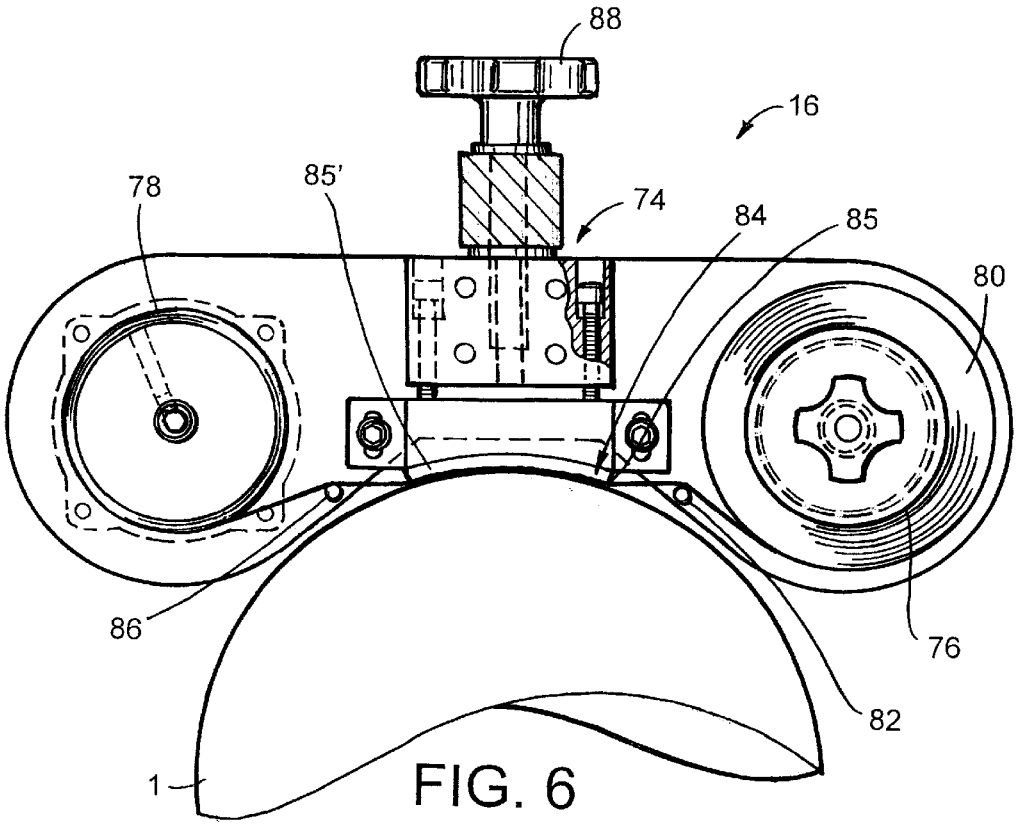
FIG. 6 is a cross-sectional view of the polisher of the present invention taken along line VI—VI in FIG. 3.
Figure 7:
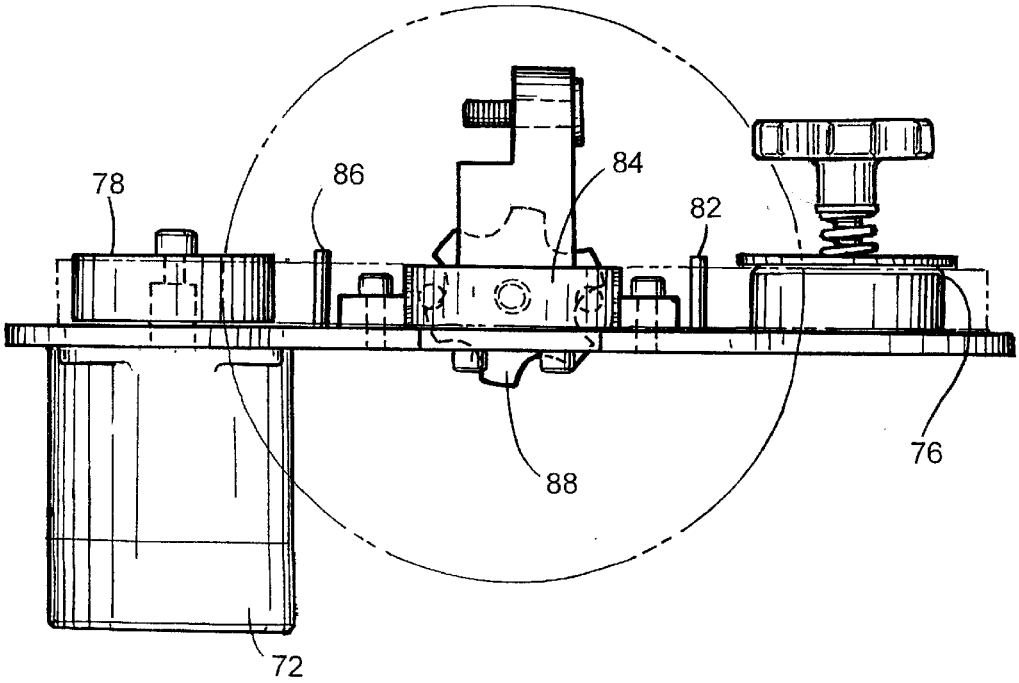
FIG. 7 is a top view of the polisher of the present invention.

FIGS. 3 and 4 also show the relationship of polisher 16 to ball spinner 12. Polisher 16 generally includes a tape holder 70, a motorized tape drive 72, and a tightener 74. Tape holder 70 includes two reels 76, 78, which are similar to a reel-to-reel audio tape mechanism (FIG. 6). Polishing tape 80 is wrapped around reel 76 and is motivated off of reel 76 by tape drive 72 and onto reel 78. Motorized tape drive 72 is preferably a stepping motor that spins reel 78 to move the tape 80. The stepping motor is an electric motor that pulses. Preferably, each pulse results in small increments of a revolution of reel 78. Such a motor compensates for the changing diameter of reel 78 with tape 80 thereon, as tape 80 is dispensed off of reel 76 and on to reel 78. Such a motor is preferable because as the diameter of the reel, including the tape, gets bigger or smaller on one end, its diameter changes and therefore, the length of tape dispensed per revolution changes. The electric stepping motor provides a consistent length advancement of tape. Tape 80 is motivated over guide post 82 and adjacent a tape support 84, which is shaped to be nearly identical in curvature to a bowling ball. As the tape is dispensed, it is moved past tape support 84, past another guide post 86, and onto reel 78. Tape support 84 has a metal backing 85 and a resilient portion 85', which is preferably made of soft rubber. This arrangement gives a soft cushion between the ball being polished and the backing 85 by conforming to the shape of the ball better. The tape can also be advanced manually by the user pulling on it.

Tapes with varying grits, or varying amounts of abrasiveness, can be, and are preferably used to polish a bowling ball. It is also contemplated that tape support 84 can be different shapes, such as cup-shaped, when using other polishing materials besides tape. These polishing materials include a compound material on fabric, a polishing rag, a liquid polishing material on fabric, or a combination of these. Different polishing materials work better for balls made of different materials, and therefore the apparatus of the present invention allows for variability and universality for polishing balls made of various materials.

Tightener 74 is a spring loaded tensioner which provides pressure of the polishing material to the ball. A knob 88 is included for radial adjustment of the tape support 84, thus resulting in varying width of contact of the polishing material on the ball. Knob 88 is used when the polishing material is a tape.

As shown in FIG. 3, the polishing apparatus 16 is attached to base 21 adjacent to ball spinner 12. The polishing device is connected to base 21 by a bracket 90 connected to a panel 92, which is in turn connected to base 21. Bracket 90 is engaged with a bar 94 that includes a centrally located slot 96. A bolt runs through bracket 90 and slot 96 to achieve attachment. On bolt 98 is a tightenable and loosenable lever 100, which tightens and loosens bar 94 against bracket 90. When loosened, this arrangement allows vertical adjustment of the polisher 16 by sliding bar 94, which is attached by brace 101 to tightener 74 by a bolt 102, up or down as desired. Once the desired vertical position is achieved, lever 100 is tightened to hold polisher 16 in place vertically.

As shown in FIG. 5, apparatus 10 also includes a fluid dispenser 14. Fluid dispenser 14 may be in the form of a sprayer, but is preferably in the form of a dripper that allows dripping of water onto the ball surface. Fluid dispenser 14 includes a hose 110 to supply water and optionally includes a pneumatic pressure hose 112 to supply pressure. Pneumatic pressure hose 112 is typically not needed because the fluid dispenser 14 can be placed in such a position to allow a constant dripping, achieved by gravity and water pressure alone, on to the ball. The water on the ball creates a similar action to "honing" in metal working. The water helps carry off the particles that are polished off the ball, thereby achieving a cleaner and more consistent polish. It is also contemplated that a solution such as a cleaning solution can be used in fluid dispenser 14, if the solution would create a desired friction and grip on the ball.

Figure 8:
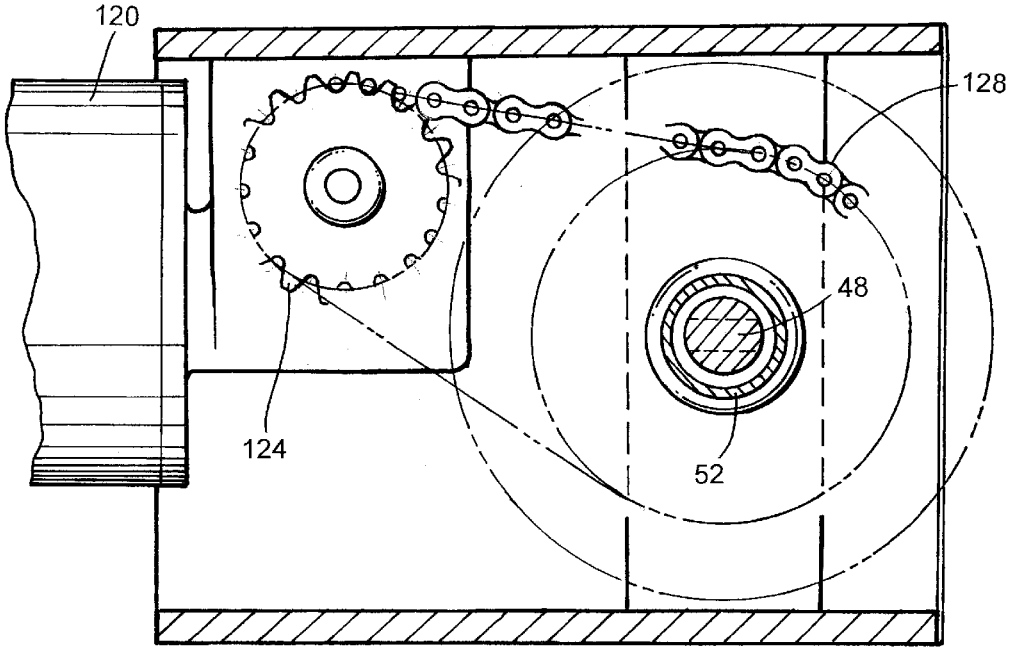
FIG. 8 is a cross-sectional view of the drive mechanism of the ball spinner of the present invention taken along line VIII—VIII in FIG. 5.
Figure 9:
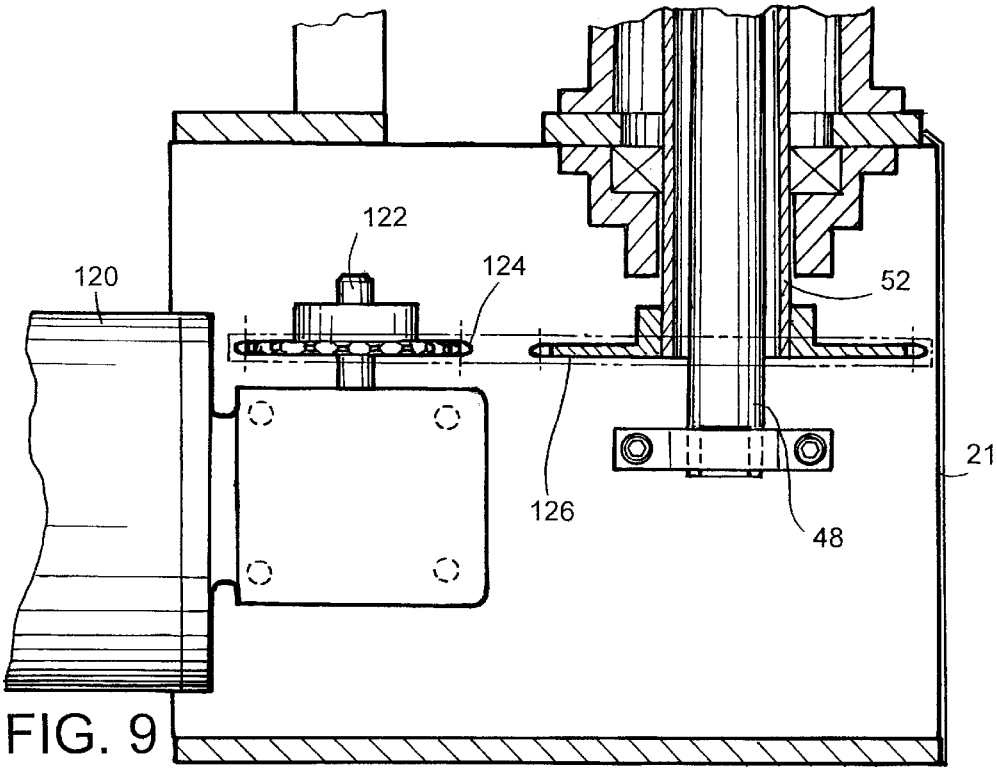
FIG. 9 is a cut-away elevational view of the drive mechanism of the ball spinner of the present invention.

FIGS. 8 and 9 show the drive portion in base 21 of the apparatus 10. Specifically, an electric motor 120 is used to turn an axle 122 which has a sprocket 124 thereon. Attached to casing 52 is a second sprocket 126 with a larger diameter than that of sprocket 124. A chain 128 is attached to both sprockets 124 and 126. When electric motor 120 is started, it spins axle 122 and thus sprocket 124. Chain 128 is rotated about sprocket 124, thus turning sprocket 126, and in turn turning casing 52, which drives the ball spinner 12.

Figure 10:
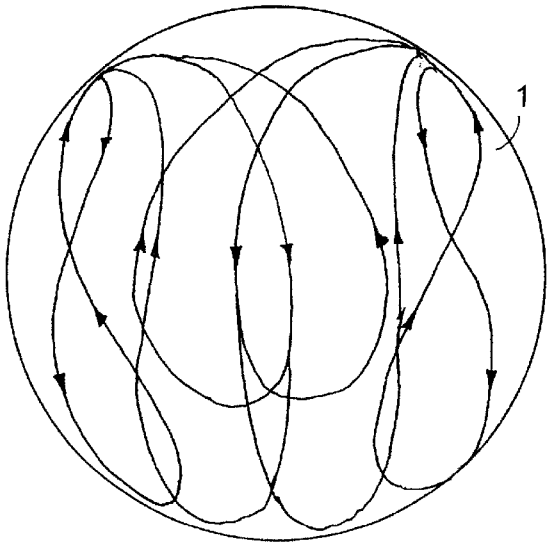
FIG. 10 is an elevational view of a ball showing the direction of polishing by using the polishing apparatus of the present invention.

In operation, a spherical object, such as a bowling ball, is placed in cradle 44, the bowling ball being supported by wheels 22, 24 at beveled edges 26, 28 and small wheels 32, 34. Polisher 16 is adjusted vertically to the desired height by using lever 100 to loosen bar 94 from bracket 90 and manually adjusting the vertical position of the polisher. Polisher 16 can be adjusted between the "north pole" (i.e., vertical plane) of the ball down to the "equator" (i.e., horizontal plane) of the ball. Tape holder 70 is adjusted radially to the desired width of polishing swipe, if tape is used as the polishing material. Fluid dispenser 14 is engaged to provide fluid onto the bowling ball. A suctioning device (not shown) or gravity is then used to draw the dispensed fluid through tube 60 from fluid that drips off of the bowling ball, into housing 20, along bottom tray 56, and through opening 58. Electric motor 120 is started which turns axle 122 and sprocket 124. Sprocket 126 is thus spun by chain 128, in turn spinning tubular casing 52 and the whole cradle 44. Cylindrical shaft 48 is also optionally rotated. As cradle 44 is spun, gear 64 "steps around" gear 62. The gear 62 and cylindrical shaft 48 stay stationary during operation. As gear 64 rotatingly moves around gear 62, axle 30 is rotated, thus rotating wheels 22 and 24 about axle 30 in the same direction. Wheels 22, 24 spin about axle 30 at a different speed or the same speed, depending on the desired effect, than the speed at which cradle 44 spins. Thus, the bowling ball is spun about two axes (i.e. a vertical axis and a changing horizontal axis) simultaneously at the same or different speeds. This creates a unique and highly desirable spinning pattern, shown in FIG. 10, that leads to a very evenly polished bowling ball.

Figure 10A:
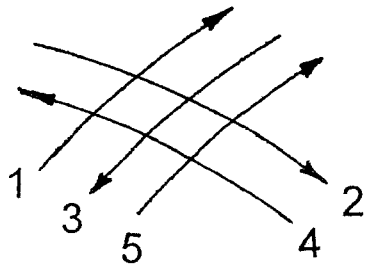
FIG. 10A is an illustration of the pattern along which a ball is polished by using the present invention.
Figure 10B:
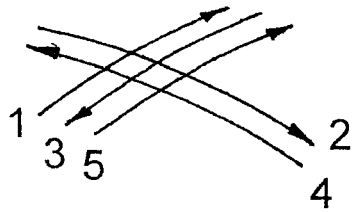
FIG. 10B is an illustration of an alternate tighter pattern along which a ball is polished by using the present invention.

FIGS. 10A and 10B show the pattern of polishing on the bowling ball by using the bowling ball spinner and polisher apparatus 10. The bowling ball is "swiped" or rotated across polishing tape 80 starting along direction ①, then along directions ②, ③, ④, and ⑤. FIG. 10B shows a "tighter" pattern, i.e. the swipes along polishing tape 80 are closer together than those in FIG. 10A. Having a tighter or looser pattern is achieved by changing the diameter of wheels 22, 24, thus changing the length ratio between (a) the distance between the center of vertical cylindrical shaft 48 and wheels 22, 24 and (b) the radius of wheels 22, 24.

The ball is spun at the desired speed and contact is achieved between tape 80 and the ball. The ball is rotated in ball spinner 10 until the desired polish is achieved. More than one polishing tape can be used on the same ball, starting with the most coarse and ending with the finest polishing tape. The process of polishing one ball once the tape is pressed against the ball should take approximately one minute, but may take less time if the ball is spun at a faster rate. The ball may be removed while the apparatus is running, and another ball may be placed onto the cradle for polishing. The apparatus of the present invention may be used for spherical objects other than bowling balls such as glass spheres for large telescopes and large ball bearings made of metal.

Figure 11A:
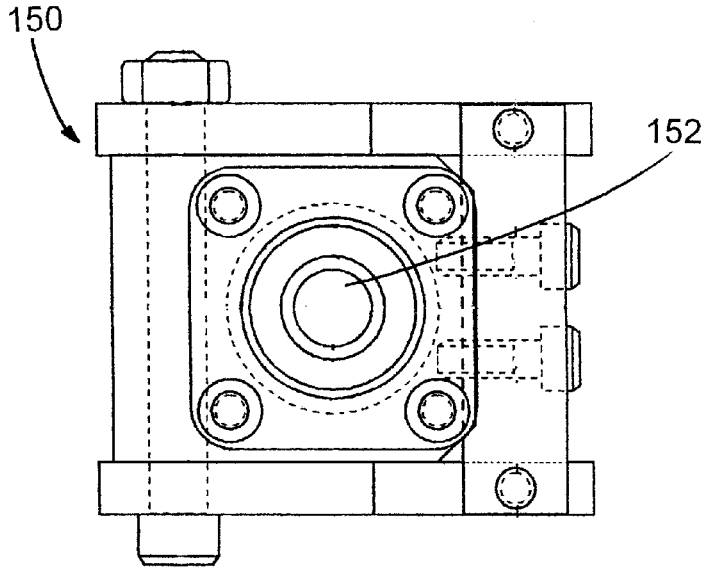
FIG. 11A is a top plan view of a hold-down apparatus for use with the ball spinner and polish apparatus of the present invention.
Figure 11B:
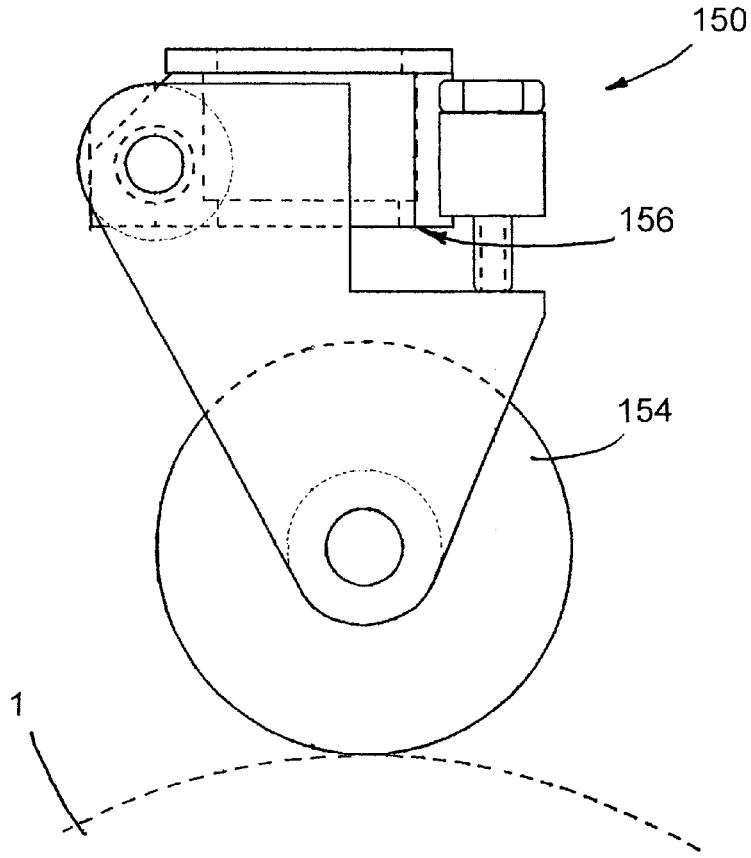
FIG. 11B is an elevational view of the hold-down apparatus show in FIG. 11A.

If the spherical object is not heavy enough to create the requisite friction to effectively be spun and polished, a hold-down apparatus, which is swivel-mounted to a framework (not shown) attached to base 21, may optionally be used. The hold-down apparatus puts pressure downward on the ball centrally from above onto cradle 44 so that the desired friction between the spherical object and the friction drive wheels is achieved. The hold-down apparatus 150 is shown in FIGS. 11A and 11B. Hold-down apparatus 150 includes an air cylinder 152, or optionally a manual clamp, to exert pressure on spherical object 1 through a wheel 154. Wheel 154 is preferably identical to wheels 32 and 34, discussed above. Wheel 154 is slightly off-center relative to the vertical axis through the center of spherical object 1, and may be adjusted away or towards that central axis. When an air cylinder is used, a spring absorber 156 is used to prevent excess pressure against spherical object 1.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. An apparatus for multi-axial rotation of a spherical object, comprising:

a cradle supported for rotation about a first axis, the cradle being shaped to support a bowling ball and including a ball spinner positioned and adapted to spin the bowling ball in the cradle about a second axis that is oriented at an angle to the first axis, the cradle being adjustable to allow different spinning pattern progressions of the bowling ball; and a first drive operably connected to the cradle for rotating the cradle about the first axis at a first speed of rotation; and a second drive connected to the ball spinner for rotating the ball spinner to spin the spherical object about the second axis at a second speed of rotation.

2. The apparatus defined in claim 1 wherein the cradle includes a first pair of wheels arranged to engage and rotate the bowling ball.

3. The apparatus defined in claim 2 wherein the second drive is connected to the first pair of wheels.

4. The apparatus defined in claim 3 wherein the cradle includes a second pair of wheels to engage the spherical object.

5. The apparatus defined in claim 4 wherein the second drive includes an axle that spins the first pair of wheels in the same direction.

6. The apparatus defined in claim 5 wherein the wheels have edges arranged to engage and rotate a bowling ball.

7. The apparatus defined in claim 5 wherein the second drive is gear driven.

8. An apparatus for rotating a spherical object comprising:

a first pair of wheels with edges arranged to engage and rotate a spherical object, said first pair of wheels being adjustable to allow different spinning pattern progressions of the spherical object;

a first drive connected to the first pair of wheels for rotating the first pair of wheels in a same direction about a first axis; and a second drive connected to the wheels for rotating the first pair of wheels simultaneously in the same direction about a second axis.

9. The apparatus defined in claim 8 wherein and further including a second pair of wheels, wherein the first pair of wheels and the second pair of wheels form a cradle for supporting a spherical object.

10. The apparatus defined in claim 9 wherein the first drive and the second drive are operably engaged by gears.

11. The apparatus defined in claim 10 wherein the first drive and second drive are engaged by an electric motor.

12. The apparatus defined in claim 11 wherein each of the wheels of the first pair of wheels has an inner diameter smaller than the outer diameter.

13. The apparatus of claim 2 wherein the distance between said first pair of wheels is adjustable thereby allowing the different spinning pattern progressions of the bowling ball.

14. An apparatus for multi-axial rotation of a spherical object, comprising:

a cradle supported for rotation about a first axis, the cradle being shaped to support a bowling ball and including a ball spinner positioned and adapted to spin the bowling ball in the cradle about a second axis that is oriented at an angle to the first axis; and a first drive operably connected to the cradle for rotating the cradle about the first axis at a first speed of rotation;

a second drive connected to the ball spinner for rotating the ball spinner to spin the spherical object about the second axis at a second speed of rotation; and a single gear operably connected to both said first and second drives for propelling both said first and second drives.

15. The apparatus defined in claim 14 wherein the cradle includes a first pair of wheels arranged to engage and rotate the bowling ball.

16. The apparatus defined in claim 15 wherein the second drive is connected to the first pair of wheels.

17. The apparatus defined in claim 16 wherein the cradle includes a second pair of wheels to engage the spherical object.

18. The apparatus defined in claim 17 wherein the second drive includes an axle that spins the first pair of wheels in the same direction.

19. The apparatus defined in claim 18 wherein the wheels have edges arranged to engage and rotate a bowling ball.

* * * * *